US009611583B2

(12) United States Patent
Hernandez et al.

(10) Patent No.: US 9,611,583 B2
(45) Date of Patent: Apr. 4, 2017

(54) DRYER DEVICE WITH DRYER SHEET HOLDER

(71) Applicant: Home Products International—North America, Inc., Chicago, IL (US)

(72) Inventors: Rolando Hernandez, Oak Lawn, IL (US); Gabriel Prero, Chicago, IL (US); Abigail Irzyk, Chicago, IL (US)

(73) Assignee: HOME PRODUCTS INTERNATIONAL-NORTH AMERICA, INC., Chicago (IL)

( * ) Notice: Subject to any disclaimer, the term of this patent is extended or adjusted under 35 U.S.C. 154(b) by 76 days.

(21) Appl. No.: 14/639,840

(22) Filed: Mar. 5, 2015

(65) Prior Publication Data

US 2016/0258105 A1 Sep. 8, 2016

(51) Int. Cl.
*D06F 58/12* (2006.01)
*D06F 39/02* (2006.01)
*D06F 58/20* (2006.01)

(52) U.S. Cl.
CPC ..... *D06F 39/024* (2013.01); *D06F 58/203* (2013.01)

(58) Field of Classification Search
CPC .... F26B 3/00; F26B 5/00; F26B 19/00; D06F 58/00; D06F 58/12
USPC ..... 34/60, 90, 595, 610; 68/19, 20, 213; 8/149, 159
See application file for complete search history.

(56) References Cited

U.S. PATENT DOCUMENTS

D96,224 S * 7/1935 Brennan ..... D1/121
2,025,657 A * 12/1935 Ganz ..... A45D 37/00 239/55
2,941,309 A * 6/1960 Cobb ..... D06F 58/203 34/380
2,956,709 A * 10/1960 Nison ..... D06F 9/024 222/129
3,435,537 A * 4/1969 Rumsey, Jr. ..... D06F 58/203 34/604
3,633,538 A * 1/1972 Hoeflin ..... D06M 23/02 118/76

(Continued)

FOREIGN PATENT DOCUMENTS

DE 2061151 A1 * 6/1971 ..... C08J 9/28
DE 4001727 7/1991

(Continued)

*Primary Examiner* — Stephen M Gravini
(74) *Attorney, Agent, or Firm* — Neal, Gerber & Eisenberg, LLP

(57) ABSTRACT

A device for softening fabrics in a dryer comprising a generally spherically-shaped outer body with one or more truncated surfaces and a securing mechanism for dryer sheets is disclosed. Various embodiments of the present disclosure include a dryer device having an open-ended body with a central securing mechanism coupled to an interior surface of the body. The securing mechanism includes a panel with a plurality of slits to form moveable flaps configured to secure a dryer sheet within the panel such that the sheet remains secured to the dryer device while tumbling through fabrics in a dryer load. The dryer device can further include a plurality of protrusions extending from an exterior wall of the open-ended body. Each protrusion can have a rounded shape that curves along a distance between the first open end and the second open end to create the generally spherical outer shape of the dryer device.

20 Claims, 3 Drawing Sheets

(56) References Cited

U.S. PATENT DOCUMENTS 3,634,947 A * 1/1972 Furgal ..... C11D 17/047 118/418
3,676,199 A * 7/1972 Hewitt et al. ..... C11D 17/047 206/0.5
3,698,095 A * 10/1972 Grand ..... D06B 1/00 206/0.5
3,706,140 A * 12/1972 Brillaud ..... D06F 58/203 118/726
3,736,668 A * 6/1973 Dillarstone ..... D06M 23/02 248/205.5
3,948,387 A * 4/1976 Haertle ..... B29C 66/81433 206/0.5
4,149,977 A * 4/1979 Morganson ..... D06M 23/00 206/0.5
4,532,722 A * 8/1985 Sax ..... D06F 58/203 206/0.5
4,567,675 A * 2/1986 Rennie ..... C11D 17/047 206/0.5
D396,904 S * 8/1998 Leu ..... D21/713
5,787,606 A * 8/1998 Bokholdt ..... D06F 58/203 34/527
5,966,831 A * 10/1999 Anderson ..... D06F 58/203 34/60
6,887,841 B2 * 5/2005 Mattia ..... C11D 17/047 34/63
6,922,913 B2 * 8/2005 Hood ..... D06F 58/203 34/595
7,309,026 B2 * 12/2007 Griese ..... D06F 58/203 206/0.5
7,921,578 B2 * 4/2011 McAllister ..... D06F 35/00 134/10
8,205,351 B2 * 6/2012 Howe ..... B67D 7/00 222/1
2002/0083615 A1 7/2002 Giblin et al.
2003/0192352 A1 * 10/2003 Wu ..... D06F 19/00 68/235 R
2009/0300933 A1 12/2009 Howe et al.
2010/0281928 A1 11/2010 Martin
2012/0085673 A1 4/2012 White
2013/0081299 A1 * 4/2013 Vasquez ..... D06F 58/203 34/389
2013/0127263 A1 5/2013 Park
2016/0258105 A1 * 9/2016 Hernandez ..... D06F 58/203

FOREIGN PATENT DOCUMENTS

EP 2465995 A1 6/2012
JP 05131110 A * 5/1993
JP H0675385 10/1994
JP 2007289618 A * 11/2007
WO WO2014035023 3/2014

* cited by examiner

DRYER DEVICE WITH DRYER SHEET HOLDER

TECHNICAL FIELD

The present disclosure relates to dryer devices, and more particularly, to dryer devices that can hold a dryer sheet.

BACKGROUND

Dryer balls are a well known dryer device in the household products field and are desirable for several reasons. For example, in a tumble dryer, the gentle movement of the dryer ball throughout a load of fabrics enables the dryer ball to act as a natural fabric softener to fluff and soften the fabrics. Dryer balls can be free of the chemicals found in many fabric softeners, making them an alternative for users with sensitive skin or certain allergies. In some instances, dryer balls help reduce dry time, which saves time and energy in completing a load of laundry. Dryer balls can be reusable for several dryer cycles and therefore, are more cost-effective and less wasteful than other dryer devices or fabric softener options, such as disposable dryer sheets. Dryer balls can also be more effective than dryer sheets, which are light in weight and often get caught in one piece of fabric, rather than moving throughout the load of fabrics.

In some instances, however, users prefer the benefits of using both a dryer ball and a dryer sheet. The dryer sheet acts as an additional fabric softener and often includes a fragrance that some users prefer. And while dryer sheets can be discarded after a single laundry load, some users reuse dryer sheets, for example, in subsequent loads of laundry, in closets and drawers for their fragrance, to eliminate static cling in clothing and other items, and various other purposes. However, regardless of whether a user wishes to discard or reuse the dryer sheet, the user must first locate the dryer sheet at the end of the laundry load, which can be difficult given the light weight and small size of dryer sheets and the tendency of the sheet to stick to a piece of fabric.

Existing dryer devices that attempt to solve the above problems have several drawbacks. For example, one known dryer ball and fabric softener combination includes securing the dryer sheet to the exterior of the dryer device. These devices still pose the risk of the dryer sheet becoming loose from the exterior of the dryer device. Certain dryer devices are rectangular and meant to stick to the side walls inside the dryer with a dryer sheet attached to the outside of the device. These devices do not move through the load so they do not provide the benefit of physically fluffing and softening fabrics by the movement of a dryer ball throughout the load. Thus, it is desirable to provide a dryer device that moves through a load of fabrics to physically fluff and soften a load of fabrics, while also moving a dryer sheet throughout the load of fabrics, all while keeping track of the dryer sheet to prohibit the dryer sheet from getting lost or stuck on one piece of fabric.

SUMMARY

The present disclosure relates to a device for effectively softening fabrics in a tumble clothes dryer, the device having a generally spherical outer circumference and a dryer sheet securing mechanism. Unlike known devices in the field that stick to one spot in the dryer, the curved or rounded shape of the dryer device of the present disclosure enables the device to tumble through the load of clothes to fluff and soften the clothes more effectively. Additionally, the securing mechanism of the dryer device enables device to early the dryer sheet throughout the load to expose all of the fabrics in the dryer to the secured dryer sheet.

Embodiments include a dryer device comprising an open-ended body including a first open end and a second open end; an interior surface extending between the first open end and the second open end; and a securing mechanism coupled to the interior surface and comprising at least one opening for securing a fabric dryer sheet. In some embodiments, the dryer device further comprises an outer surface extending between the first open end and the second open end; and a plurality of protrusions extend outwardly from the outer surface.

Embodiments also include a dryer device comprising an outer body with a generally spherical outer circumference, the outer body being truncated at a first surface by a first open end and at a second surface by a second open end; a hollow cylindrical interior extending between the first open end and the second open end; and a securing mechanism comprising at least one opening for securing a fabric dryer sheet such that the secured dryer sheet extends through the first open end and through the second open end. In some embodiments, the dryer device further comprises a plurality of protrusions extending from an outer surface of the cylindrical interior to form the generally spherical outer circumference.

Thus, embodiments of the present disclosure eliminate stray dryer sheets from getting caught in pant legs, pockets, and on laundry room floors. Further, the dual-purpose product gives the user the benefits of a dryer ball and a dryer sheet all in one.

Other objects, advantages, features, properties and relationships of the invention will be obtained from the following detailed description and accompanying drawings which set forth illustrative embodiments that are indicative of the various ways in which the principles of the invention may be employed.

DETAILED DESCRIPTION

The description that follows describes, illustrates and exemplifies one or more embodiments of the present invention in accordance with its principles. This description is not provided to limit the invention to the embodiments described herein, but rather to explain and teach the principles of the invention in order to enable one of ordinary skill in the art to understand these principles and, with that understanding, be able to apply them to practice not only the embodiments described herein, but also other embodiments that may come to mind in accordance with these principles. The scope of the present disclosure is intended to cover all such embodiments that may fall within the scope of the appended claims, either literally or under the doctrine of equivalents.

Various embodiments of the present disclosure include a dryer device that comprises an outer body with a generally spherical outer circumference and one or more truncated surfaces. The dryer device further includes an open-ended cylinder comprising a dryer sheet securing mechanism. The dryer sheet securing mechanism includes one or more openings configured to secure a dryer sheet within a hollow interior of the cylinder, such that the dryer sheet stays secured within the dryer device while tumbling with the fabrics in the dryer for the duration of the dryer cycle. In embodiments, the dryer sheet securing mechanism is coupled to an interior surface of the cylinder of the dryer device and includes a central panel. In a preferred embodiment, the central panel is located parallel to and equidistant from both openings of the cylinder. The dryer device further includes a plurality of protrusions extending from an exterior surface of the cylinder. In a preferred embodiment, the protrusions are rounded fin-shaped structures that extend across the length of the cylinder and protrude perpendicularly to the exterior surface of the cylinder, thus forming the generally spherical outer circumference. The protrusions enable the dryer device to move easily through the fabrics in the dryer to fluff the fabrics without getting caught therein for the duration of the dryer cycle.

Figure 1:
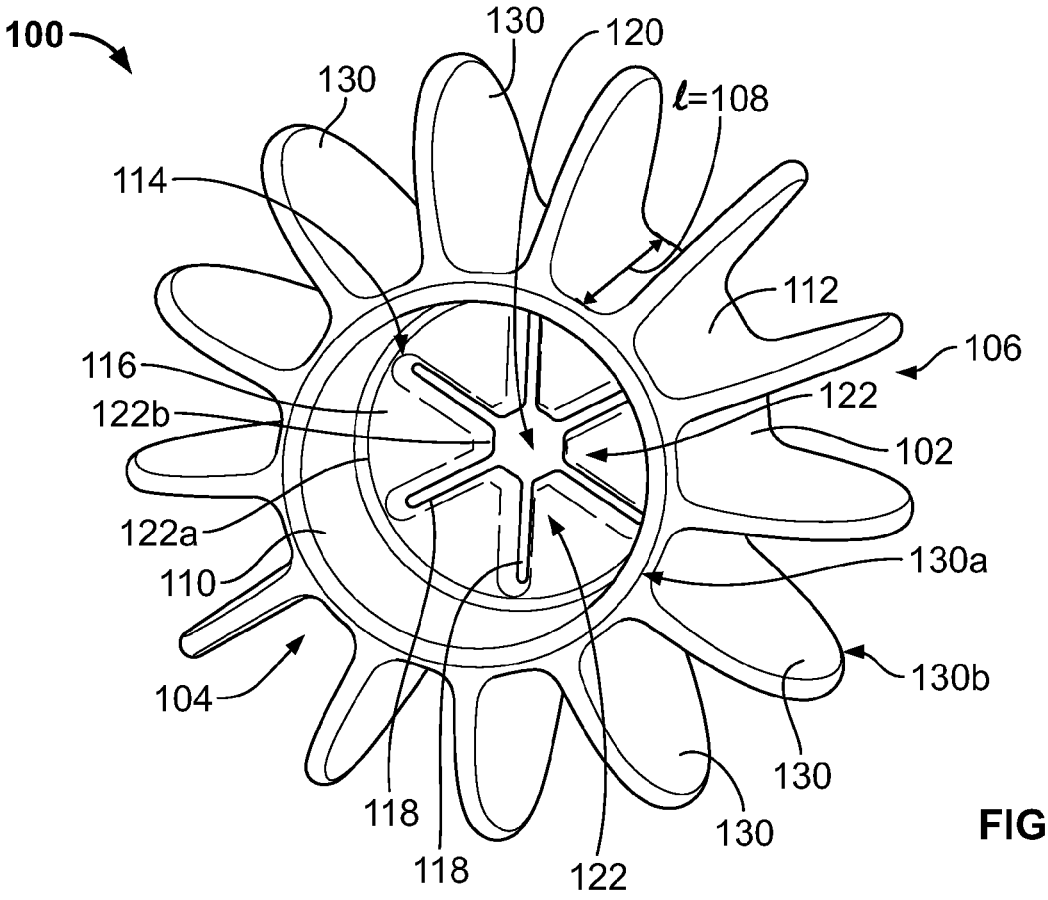
FIG. 1 is a front perspective view of a dryer device with a dryer sheet holder in accordance with various embodiments.
Figure 2:
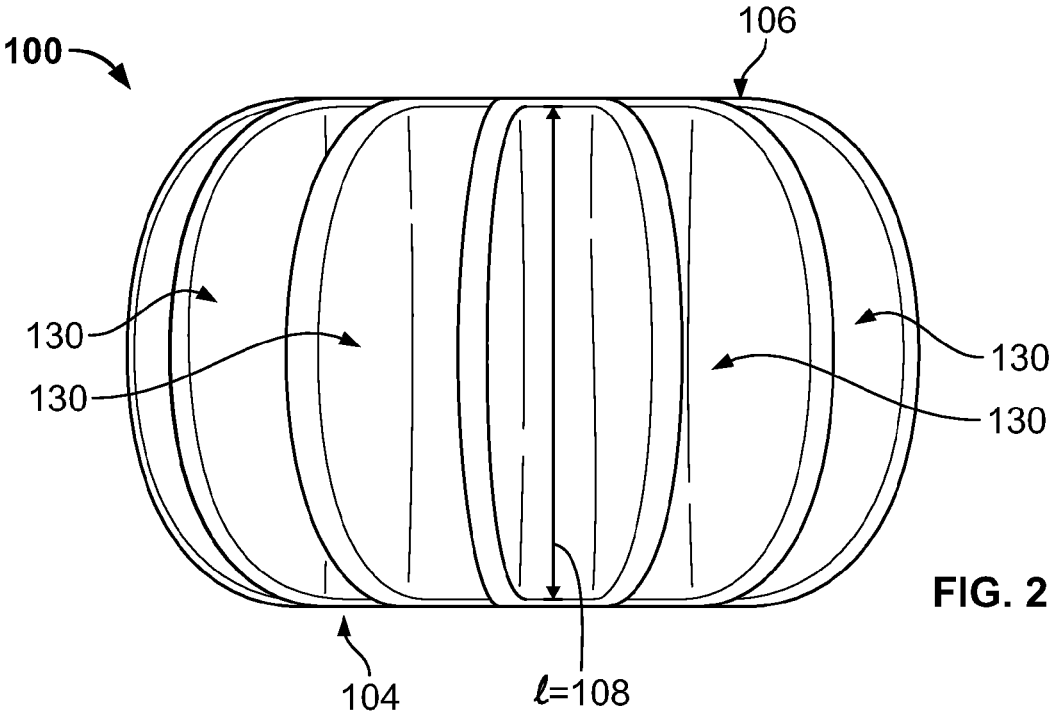
FIG. 2 is a side view of a dryer device with a dryer sheet holder in accordance with various embodiments.

FIG. 1 is a perspective view of a dryer device 100. FIG. 2 is a side view of the dryer device 100. As shown in FIGS. 1 and 2, the dryer device 100 includes a cylindrical interior body 102 (also referred to herein as a "cylinder" or "open-ended body") having a first open end 104 and a second open end 106. The length 108 of the cylinder 102 extends from the first open end 104 to the second open end 106. The cylinder 102 has an interior surface 110 and an exterior surface 112. In the illustrated embodiment, the center or interior of the cylinder 102 is hollow except for a securing mechanism 114. As also illustrated, a plurality of protrusions 130 extend from the exterior surface 112 of the cylinder 102 and form an outer body of the cylinder 102. In one embodiment, the dryer device 100 is a one-part injection molded device. The dryer device 100 can be made of any suitable heat resistant material that can withstand high drying temperatures.

In embodiments, each of the protrusions 130 has a rounded edge and extends along the length 108 of the cylinder 102 such that the outer body of the dryer device 100 has a generally spherical outer shape that is truncated at the open ends 104 and 106 of the cylinder 102. In a preferred embodiment, each of the plurality of protrusions 130 has a uniform, substantially flat, fin-like shape that extends in a perpendicular direction from the exterior surface 112 of the cylinder 102. As illustrated, each of the plurality of protrusions 130 (also referred to herein as "fins") includes a fixed end 130*a* and a moveable end 130*b*. The width of the fixed end 130*a* of each of the plurality of fins 130 is equivalent to the length 108 of the cylinder, or the distance from the first open end 104 to the second open 106 end. Each of the plurality of fins 130 tapers from the fixed end 130*a* to a curved edge of the moveable end 130*b*. More specifically, each side of the fin 130 curves away from the open ends 104, 106, respectively, and towards a central point of the moveable end 130*b*, thus forming a generally spherical outer circumference for the outer body of the dryer device 100. The moveable end 130*b* is flexible in order to allow the dryer device 100 to move throughout the fabrics of the dryer load without getting caught therein. In a preferred embodiment, the fixed end 130*a* is thicker than the movable end 130*b*. In certain embodiments, the protrusions 130 are spaced substantially equidistant apart from each other along or throughout an entirety of the exterior surface 112 of the cylinder 102.

As will be appreciated, other shapes and/or configurations for the various components of the dryer device 100 are possible in accordance with the techniques and principles described herein. For example, in the illustrated embodiment, the dryer device 100 can be described as having a thick cylindrical or disk-like shape due to the location at which the open ends 104, 106 truncate the generally spherical outer shape of the dryer device 100. In other cases, the overall shape of the dryer device 100 can be more spherical and less truncated, for example, by decreasing the length 108 of the cylinder 102, decreasing a radius of the open ends 104, 106, and/or increasing a curvature of the protrusions 130. In some cases, the dryer device 100 may form a complete sphere (not shown) with no truncated surfaces and have a plurality of openings within an outer surface of the sphere for receiving and securing the dryer sheet, in other cases, the overall shape of the dryer device 100 can be more disk-like, for example, by decreasing the length 108 of the cylinder 102, increasing the radius of the open ends 104, 106, and/or decreasing the curvature of the protrusions 130. Further, while the protrusions 130 are described and shown herein as having a substantially flat, fin-like shape, it will be appreciated that other shapes and/or configurations are possible in accordance with the techniques and principles described herein, including, for example, rounded nubs, blunt spikes, and other extensions of varying shapes.

Figure 3:
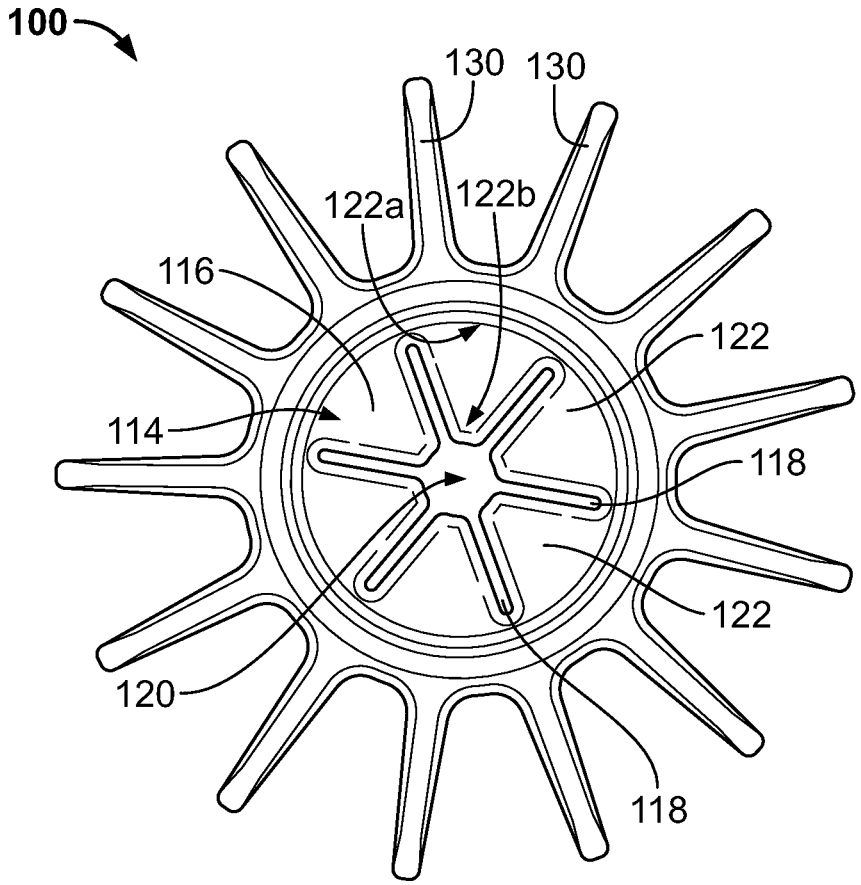
FIG. 3 is a top plan view of a dryer device with a dryer sheet holder in accordance with various embodiments.

FIG. 3 is a top view of the dryer device 100. As shown in FIG. 3, in one embodiment, the securing mechanism 114 includes a panel 116 with a plurality of openings 118. The panel 116 extends inwardly from the interior surface 110 of the cylinder 102, towards a center of the cylinder 102, and can be parallel to the first open end 104 and the second open end 106, as shown in FIG. 3. In one embodiment, the panel 116 is equidistant from the first open end 104 and the second open end 106. In the illustrated embodiment, the openings 118 are long, narrow apertures, or slits, that extend radially from a center 120 of the panel 116 towards the interior surface 110, leaving an open space at the center 120 of the panel 116 and creating a plurality of flexible flaps 122 between each adjacent pair of openings 118 (also referred to herein as "slits"). Each flap 122 has a fixed end 122*a* and a moveable end 122*b*. The fixed end 122*a* of the flap 122 extends from the interior surface 110 of the cylinder 102. The moveable end 122*b* of the flaps 122 is at the center 120 of the panel 116. The moveable end 122*b* of the flaps 122 are capable of moving back and forth towards the first open end 104 and the second open end 106, thereby allowing for easy adjustment of the open space between the moveable ends 122*b* at the center 120 of the panel 116.

Figure 4:
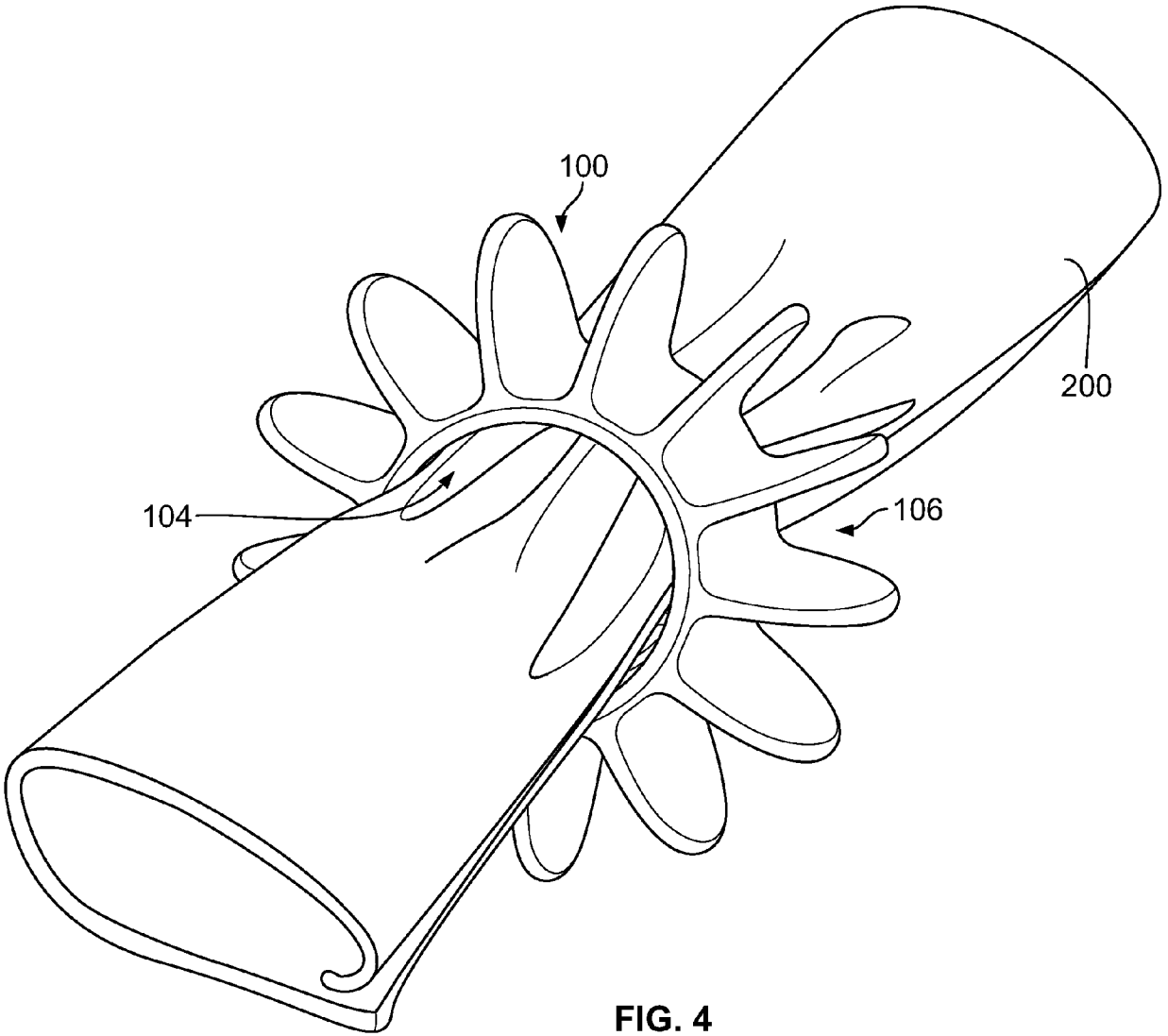
FIG. 4 is a front perspective view of a dryer device with a dryer sheet holder and a dryer sheet in accordance with various embodiments.

As shown in FIG. 4, in one embodiment, the securing mechanism 114 is configured such that a dryer sheet 200 can be pushed through the center 120 and the open spaces between the moveable ends 122*b* of the flaps 122 and can be securely held between the flaps 122. As depicted in FIG. 4, in a preferred embodiment, the dryer sheet 200 protrudes from both the first open end 104 and the second open end 106 to maximize exposure of the dryer sheet 200 to the fabric in the laundry load. Additionally, the small openings formed between adjacent pairs of the movable ends 122*b* of the flaps 122 hold the dryer sheet securely at the center 120. Accordingly, the dryer device 100 keeps the dryer sheet 200 from sticking to fabric in the load or becoming difficult to find after the dryer load is complete. It should be appreciated that this also enables a user to more easily reuse the dryer sheet after the load is complete.

Other configurations for the securing mechanism 114 are also possible according to the techniques and principles described herein. For example, in some cases, at least a portion of the panel 116 can extend perpendicularly to the first open end 104 and the second open end 106. In such cases, each of the flaps 122 may form an elbow shape such that the movable end 122*b* is perpendicular to the fixed end 122*a*. In other cases, instead of the central panel 116, the securing mechanism 114 can include a slit (not shown) through a side wall of the cylinder 102 and between two adjacent protrusions 130. In such cases, the dryer sheet 200 can be secured through the slit on the side wall of the cylinder 102, so that the dryer sheet 200 is positioned partially within the hollow body of the cylinder 102 and partially between the two protrusions 130.

Thus, the present disclosure provides a dryer device 100 with a securing mechanism 114 to secure a dryer sheet 200 thereto, such that a user can enjoy the benefits of both a dryer ball and a dryer sheet without losing the dryer sheet in the load.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed is:

1. A dryer device comprising:

an unattached body including a first open end and a second open end;

an exterior surface extending over the body between the first open end and the second open end;

an interior surface extending through the body between the first open end and the second open end; and a securing mechanism coupled to the interior surface and comprising at least one aperture configured to receive at least a portion of a fabric dryer sheet there through.

2. The dryer device of claim 1, further comprising:

a plurality of protrusions extend outwardly from the exterior surface.

3. The dryer device of claim 2, wherein the plurality of protrusions extend substantially perpendicularly from the exterior surface.

4. The dryer device of claim 2, wherein each protrusion has a width equal to a distance between the first open end and the second open end.

5. The dryer device of claim 4, wherein each protrusion has a rounded shape that curves along the distance between the first open end and the second open end.

6. The dryer device of claim 2, wherein the plurality of protrusions are spaced equidistant apart throughout the exterior surface.

7. The dryer device of claim 1, wherein the securing mechanism comprises a panel extending inwardly from the interior surface, the panel including the at least one aperture.

8. The dryer device of claim 7, wherein the panel is parallel to the first open end and the second open end.

9. The dryer device of claim 7, wherein the at least one aperture includes a plurality of slits radially extending from a center of the panel.

10. The dryer device of claim 9, wherein the plurality of slits form a plurality of moveable flaps for securing the dryer sheet within the panel.

11. The dryer device of claim 7, wherein the panel is positioned on the interior surface equidistant from the first open end and the second open end.

12. A dryer device comprising:

an outer body having a generally spherical circumference, a first open end, and a second open end;

an interior body extending between the first open end and the second open end; and a securing mechanism coupled to an inner surface of the interior body and comprising at least one aperture configured to receive at least a portion of a fabric dryer sheet there through, such that one end of the dryer sheet extends through the first open end and an opposite end of the dryer sheet extends the second open end.

13. The dryer device of claim 12, wherein the outer body comprises a plurality of protrusions extending from an exterior surface of the interior body to form the generally spherical outer circumference.

14. The dryer device of claim 13, wherein each of the plurality of protrusions extends substantially perpendicularly from the exterior surface.

15. The dryer device of claim 13, wherein each of the plurality of protrusions has a rounded shape that extends from the first open end to the second open end and curves along a distance between the first open end and the second open end.

16. The dryer device of claim 12, wherein the securing mechanism comprises a panel extending inwardly from the inner surface, the panel including the at least one aperture.

17. The dryer device of claim 16, wherein the at least one aperture includes a plurality of slits radially extending from a center of the panel.

18. The dryer device of claim 17, wherein the plurality of slits form a plurality of moveable flaps for securing the dryer sheet within the panel.

19. The dryer device of claim 16, wherein the panel is positioned on the inner surface equidistant between the first open end and the second open end.

20. The dryer device of claim 16, wherein the panel is parallel to the first open end and the second open end.

* * * * *